US008096864B2

(12) United States Patent
Moshal

(10) Patent No.: US 8,096,864 B2
(45) Date of Patent: Jan. 17, 2012

(54) GAMING SYSTEM AND METHOD OF OPERATION THEREOF

(75) Inventor: Martin Moshal, Gibraltar (GI)

(73) Assignee: Waterleaf Limited, Douglas (IM)

( * ) Notice: Subject to any disclaimer, the term of this patent is extended or adjusted under 35 U.S.C. 154(b) by 936 days.

(21) Appl. No.: 12/032,578

(22) Filed: Feb. 15, 2008

(65) Prior Publication Data

US 2008/0167104 A1 Jul. 10, 2008

Related U.S. Application Data

(62) Division of application No. 11/558,530, filed on Nov. 10, 2006, now Pat. No. 7,354,042, which is a division of application No. 10/496,037, filed as application No. PCT/IB2002/004963 on Nov. 27, 2002, now Pat. No. 7,147,226.

(30) Foreign Application Priority Data

Nov. 28, 2001 (GB) ..... 0128495.9

(51) Int. Cl.
*A63F 9/24* (2006.01)

(52) U.S. Cl. ..... 463/12; 463/10; 463/20; 463/40

(58) Field of Classification Search ..... 463/10, 463/12, 20, 40
See application file for complete search history.

(56) References Cited

U.S. PATENT DOCUMENTS 5,116,055 A * 5/1992 Tracy ..... 463/27
5,823,879 A * 10/1998 Goldberg et al. ..... 463/42
5,836,586 A 11/1998 Marks et al.
5,979,897 A * 11/1999 Grossman ..... 273/292
6,089,980 A * 7/2000 Gauselmann ..... 463/27
6,113,102 A 9/2000 Marks et al.
6,158,741 A * 12/2000 Koelling ..... 273/292
6,179,292 B1 * 1/2001 Aramapakul ..... 273/292
6,217,024 B1 4/2001 Lofink et al.
6,273,424 B1 8/2001 Breeding
6,311,978 B1 11/2001 Moody
6,334,614 B1 1/2002 Breeding
6,464,584 B2 10/2002 Oliver
6,471,210 B1 10/2002 Goldman et al.
6,523,829 B1 2/2003 Walker et al.
6,540,230 B1 4/2003 Walker et al.
6,626,433 B2 9/2003 Scibetta
6,634,946 B1 10/2003 Bridgeman et al.
6,679,497 B2 1/2004 Walker et al.
6,719,291 B1 4/2004 deKeller (Continued)

FOREIGN PATENT DOCUMENTS

WO 00/35545 A1 6/2000

*Primary Examiner* — Dmitry Suhol
*Assistant Examiner* — Brandon Gray
(74) *Attorney, Agent, or Firm* — McDonnell Boehnen Hulbert & Berghoff LLP

(57) ABSTRACT

A gaming system comprises a primary wagering facility which is usable by a player to place an initial wager on a turn of a game of blackjack, and a secondary wagering facility which automatically places a side wager on the same turn of the game of blackjack. The side wager relates to an outcome which is a function of a number of different playing cards contained in the blackjack hand dealt to the player in turn of the game of blackjack. The side wager is paid at odds of at least 2 to 1 if the first dealt card in the player's hand is of a predetermined rank.

9 Claims, 1 Drawing Sheet

U.S. PATENT DOCUMENTS

| | | | | |
|---|---|---|---|---|
| 6,726,427 | B2 | 4/2004 | Jarvis et al. | |
| 6,869,075 | B1 | 3/2005 | Stavinsky | |
| 6,877,748 | B1 | 4/2005 | Patroni et al. | |
| 6,902,166 | B2 | 6/2005 | Stern | |
| 6,938,900 | B2 | 9/2005 | Snow | |
| 6,960,134 | B2 | 11/2005 | Hartl et al. | |
| 6,962,530 | B2 | 11/2005 | Jackson | |
| 6,986,514 | B2 | 1/2006 | Snow | |
| 7,147,226 | B2 | 12/2006 | Moshal | |
| 7,354,042 | B2 | 4/2008 | Moshal | |
| 2002/0027324 | A1* | 3/2002 | Webb | 273/292 |
| 2003/0109306 | A1 | 6/2003 | Karmarkar | |
| 2004/0102238 | A1* | 5/2004 | Taylor | 463/16 |
| 2005/0161884 | A1* | 7/2005 | Au-Yeung et al. | 273/292 |

* cited by examiner

GAMING SYSTEM AND METHOD OF OPERATION THEREOF

CROSS-REFERENCE TO RELATED APPLICATIONS

This is a division of application Ser. No. 11/558,530, filed Nov. 10, 2006, which is a division of application Ser. No. 10/496,037, now U.S. Pat. No. 7,147,226, which was the U.S. national stage of International Application No. PCT/IB02/04963, filed Nov. 27, 2002, all of which are incorporated herein by reference.

FIELD OF THE INVENTION

This invention relates to a gaming system that enables a user thereof to place a wager on, and to play, a game and, more particularly, to a system which enables a user thereof to place a wager on, and to play, a game of chance, in this instance, a game of blackjack. The invention extends to a method of operation of the gaming system.

BACKGROUND TO THE INVENTION

The game of blackjack is well known and widely played in most land-based casinos.

At the simplest level, the game of blackjack is played between each one of a number players and a dealer, representing a "house". During a turn of the game, each player is required to make an initial wager on the outcome of two hands of playing cards, one hand being dealt to the player and the other hand being dealt to the dealer, respectively. After making the initial wager, each player is dealt two cards face up and the dealer is dealt one card face up from one or more decks of 52 playing cards.

Each card is deemed to have a point value as follows: a deuce to a ten is deemed to have a point value equal to the face value of that card; a Jack, a Queen or a King is deemed to have a value of 10, while an Ace is deemed to have a value of 1 or, optionally, 11, at the discretion of the player and the dealer, respectively.

Each player is then required to decide, on the basis of the two playing cards which have been dealt to him, and the dealer's exposed playing card, whether to draw additional cards, one at a time, to augment the player's hand (that is, to "hit"), or not to draw any further additional cards for augmentation of the player's hand (that is, to "stand"). If the total point value of the cards in the player's hand exceeds 21 at any, the player is deemed to have "bust", in which case the initial wager is forfeited to the house, and the player takes no further part in that turn of the game.

Once each player in that turn of the game has elected to stand, or has bust, the dealer augments his hand by drawing additional cards, one at a time, according to the following rules:

1. the dealer must hit if the total point value of the cards in the dealer's hand is less than 17;
2. the dealer must stand if the total point value of the cards in the dealer's hand in greater than or equal to 17;
3. the dealer busts if the total point value of the cards in the dealer's hand is greater than 21. If the dealer busts while the player has not, the player wins the initial wager at even money.

Where neither the player nor the dealer has bust, the outcome of the wager is decided by comparing the total point value of the player and dealer hands. If the player's hand has the higher total point value, the player wins the initial wager at even money. If the dealer's hand has the higher point value, the player's initial wager is forfeited to the house. In the event that the total point values of the player and dealer's hands are equal, the initial wager is neither forfeited not won by the player. There are numerous variations to these rules of the game of blackjack, which are not material to the invention, and which will not be described here in detail.

A disadvantage of this game of conventional blackjack is a lack of variety, which can cause the game to become monotonous, particularly in a multi-player situation, and which can result in a player's interest in the game to wane rapidly.

In order to overcome this problem, it is known to introduce an optional side wager into the game, which a player may elect to exercise in order to liven up the progress of the game. A disadvantage with this particular variation of the game is that a player is required to take a conscious decision whether to exercise the optional side wager, or not, at every turn of the game, which can also cause the player's interest in the game to wane.

A further disadvantage of the game blackjack, when cards are dealt by hand in a land-based casino, is that the progress of the game as a whole is slow, which restricts the rate at which succeeding turns of the game can be played. The problem is further exacerbated when the optional side wager is introduced into the game, as a croupier is required to manage and administer the players' side wagers in addition to the initial wagers, thereby slowing the game down even further.

OBJECT OF THE INVENTION

It is an object of this invention to provide a gaming system, and a method of operation thereof, that will, at least partially, alleviate the above-mentioned difficulties and disadvantages.

SUMMARY OF THE INVENTION

In accordance with this invention there is provided a gaming system, comprising:

a primary wagering facility operable to place an initial wager on a turn of a game of blackjack;

a secondary wagering facility responsive to the primary wagering means to automatically place a side wager on the same turn of the game of blackjack; and dealing means operable to deal a blackjack hand corresponding to a dealer, and a blackjack hand corresponding to a user of the system Further features of the invention provide for the gaming system to include an accumulation facility operable to accumulate a portion, at least one percent, of each side wager in a pooled jackpot, for the pooled jackpot to exceed a predetermined minimum amount at all times during the course of the game of blackjack, and for the accumulation facility to increment the pooled jackpot at a predetermined rate, even when the game of blackjack is not being played by the user of the system.

Still further features of the invention provide for the side wager to relate to an outcome which is a function of a number of different playing cards contained in the blackjack hand dealt to the user of the system, for the side wager to relate to an outcome which is a function of a first three cards dealt in the user's blackjack hand, for the side wager to be paid at odds of at least 2 to 1 if the first card dealt is of a predetermined rank, for the side wager to be paid at odds of at least 10 to 1 if the first two cards dealt are of the predetermined rank and of different suites, for the side wager to be paid at odds of at least 20 to 1 if the first two cards dealt are of the predetermined rank and of the same suite, for the side wager to be paid at odds of at least 100 to 1 if the first three cards dealt are of the predetermined rank and are not all of the same suite, for the side wager to be paid at odds of at least 250 to 1 if the first three cards dealt are of the predetermined rank and of the same suite, for the side wager to be paid an amount of the pooled jackpot if the first three cards dealt are each of the predetermined rank and of a predetermined suite, for the predetermined rank to be a seven, and for the predetermined suite to be diamonds.

The invention extends to a method of operation of a gaming system, which includes the steps of:

placing an initial wager on a turn of a game of blackjack;

automatically placing a side wager on the same turn of the game of blackjack in response to the placing of the initial wager; and dealing a blackjack hand corresponding to a dealer, and a blackjack hand corresponding to a user of the system.

There is further provided for accumulating a portion of each side wager in a pooled jackpot, for providing that the pooled jackpot exceeds a predetermined minimum amount at all times during a course of the game of blackjack, and for incrementing the pooled jackpot at a predetermined rate, even when no user of the system is playing the game of blackjack.

There is still further provided for relating the side wager to an outcome that is a function of a number of different playing cards contained in the blackjack hand dealt to the user of the system, for relating the side wager to an outcome that is a function of a first three cards dealt in the user's blackjack hand, for paying the side wager at odds of at least 2 to 1 if the first card dealt is of a predetermined rank, for paying the side wager at odds of at least 10 to 1 if the first two cards dealt are of a predetermined rank and of different suites, for paying the side wager at odds of at least 20 to 1 if the first two cards dealt are of the predetermined rank and of the same suite, for paying the side wager at odds of at least 100 to 1 if the first three cards dealt are of the predetermined rank and of not all of the same suite, for paying the side wager at odds of at least 250 to 1 if the first three cards dealt are of the predetermined rank and of the same suite, for paying the side wager an amount of the pooled jackpot if the first three cards dealt are each of the predetermined rank and of a predetermined suite, for the predetermined rank to be a seven, and for the predetermined suite to be diamonds.

The invention extends further to a method of operating a gaming server, including the steps of:

accepting an initial wager placed by a user on a turn of a game of blackjack;

automatically accepting a side wager on the same turn of the game of blackjack in response to placement of the initial wager; and dealing a blackjack hand corresponding to a dealer, and a blackjack hand corresponding to the user.

BRIEF DESCRIPTION OF THE DRAWINGS

One embodiment of the invention is described below, by way of example only, and with reference to the accompanying drawings in which.

DETAILED DESCRIPTION OF THE INVENTION

Figure 1:
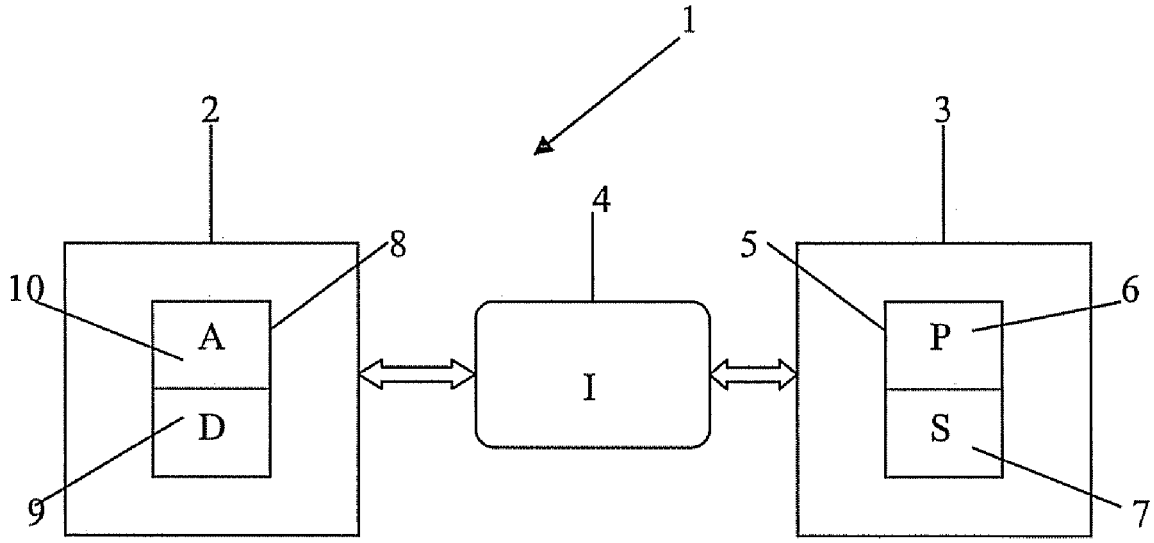
FIG. 1 is a schematic representation of a system for placing wagers, according to the invention.

Referring to FIG. 1, a gaming system is indicated generally by reference numeral (1).

The system (1) includes a gaming server (2) and a user access facility in the form of a computer workstation (3) remote from the gaming server. The computer workstation (3), which has an associated display, is located remotely from the gaming server (2) and is connected thereto by means of an open communication network (4) that is, in this embodiment, the World Wide Web of the Internet.

The computer workstation (3) is a conventional personal computer operating under a Windows 2000 operating system, which is well known and commercially available from the Microsoft Corporation of Seattle, Wash., USA. The computer workstation (3) executes a stored simulation software program (5) that simulates the progress of a game of blackjack. The operation of the stored simulation software program (5) will be described in more detail in the description that follows.

A user wishing to play the game of blackjack is first required to register and to create an account on the gaming server (2). The user is then require to pre-fund the account by purchasing credit that will, for convenience, be denominated in this description in "units". The gaming server (2) stores a credit balance corresponding to the user's account at all times.

In order to commence play, the user uses the computer workstation (3) to log onto the gaming server (2) and initiates execution of the stored simulation software program (5), which displays to the user of the system (1) a playing surface on which a game of a blackjack is played. The playing surface is demarcated in a number of separate playing positions, allowing the user to play either one or multiple hands of blackjack during any turn of the game. For convenience, this embodiment will be described with reference to a single hand of blackjack played by the user, although it must be clearly understood that the invention encompasses the playing of multiple hands of the game, simultaneously, by the user.

The stored simulation software program (5) in the computer workstation (3) provides the user with a primary wagering facility (6) in the form of a bet placement icon that enables the user to place an initial wager on a turn of the game. The player now enters a betting phase of the game by activating the bet placement icon in order to place the initial wager. The size of the wager is displayed to the user on the computer workstation. The stored simulation software program (5) also provides a secondary wagering facility (7) that automatically places a corresponding side wager on the same turn of the game in response to placement of the initial wager by the user. It is an essential aspect of this invention that the corresponding side wager is automatically placed by the secondary wagering facility (7), without requiring any intervention by the user. The user has no discretion as to whether or not to place the side wager. There must be sufficient credit in the user's account to cover any wager that is made. The user can make other eager of the same or different amounts on other playing positions. Data relating to the size of each wager made by the user is transmitted by the computer workstation (3) across the communication network (4) to the gaming server (2) for storage on an associated storage device (not shown).

Once the user has placed the initial wager and the corresponding secondary wager in the above manner, the computer workstation (3) instructs the gaming server (2) to deal a blackjack hand corresponding to a dealer, and a blackjack hand corresponding to the user of the system (1).

The gaming server (2) executes a computer program (8) that provides a dealing means (9), which generates random events that determine the progress of the game of blackjack. In particular, the random event generation program is executable on the gaming server (2) to "deal", on a random basis, cards that make up hands that are dealt to a player and to a dealer, respectively, in the game of blackjack. The operation of such a random event generation program is well known in the art and will not be described here in detail. The random event generation program (8) in the gaming server (2) deals, from a shoe (not shown) consisting of 5 conventional decks of 52 playing cards each, two cards for the user and one card for the dealer. The gaming server (2) then transmits the rank and suite of the dealt cards corresponding to the user and to the dealer, to the computer workstation (3) along the open communication channel (4) for display by the stored simulation software program (5) to the user on the display of the computer workstation (3).

The game then progresses in a conventional manner with the user being prompted by the stored simulation software program (5) on the computer workstation (3) to decide, on the basis of the playing cards that have been dealt to him, and the dealer's exposed playing card, whether to "hit" or "stand" as described above. Once the user's turn is completed, without having bust, the dealer's hand is played according to rules that are well known in the art, and which are outlined above. The outcome of the initial wager is determined by the stored program in the gaming server (2), according to conventional rules of the game of blackjack.

The computer program (8) also provides an accumulation facility (10), which is a further computer program that accumulates a portion consisting of at least 1% of the amount of each side wager in a pooled jackpot (not shown), the running total of which is displayed to the user on the display of the computer workstation (3). The pooled jackpot (not shown) exceeds a minimum amount, in this embodiment 5 001 units of credit, at all times. The pooled jackpot (not shown) also accumulates at a predetermined base rate of 0.001 units of credit per second, even when the user is not playing the game of blackjack.

The outcome of the side wager is determined as follows:

1. the side wager will be successful if the first card dealt in the user's blackjack hand is a 7, of any suite. In such an instance, the successful side wager is paid an amount of 2 times the size of the side wager;
2. the side wager will also be successful if the first two cards dealt in the user's blackjack hand are each a 7, but of different suites. In such an instance, the successful side wager is paid an amount of 10 times the size of the side wager;
3. the side wager will also be successful if the first two cards dealt in the user's blackjack hand are each a 7, and all of the same suite. In such an instance, the successful side wager is paid an amount of 20 times the size of the side wager;
4. the side wager will also be successful if the first three cards dealt in the user's blackjack hand are each a 7, and not all of the same suite. In such an instance, the successful side wager is paid an amount of 100 times the size of the side wager;
5. the side wager will also be successful if the first three cards dealt in the user's blackjack hand are each a 7, and all of the same suite. In such an instance, the successful side wager is paid an amount of at least 250 times the size of the side wager;
6. the side wager will also be successful if the first three cards dealt in the user's blackjack hand are each a 7 of diamonds. In such an instance, the successful side wager is paid an accumulated amount of the pooled jackpot.

Once the user's initial and side wagers have been settled as described above, the turn of the game of blackjack is complete and the player may begin a further turn of the game by making other initial wagers on one or more of the playing locations displayed on the display of the computer workstation (3).

It will be appreciated by those skilled in the art that the side wager made by the player in the manner described above is, in fact, a wager that an unbroken progression of the same rank of card is dealt in the first three cards dealt in the user's blackjack hand. The outcome of the side wager is thus dependent on the make-up of the user's blackjack hand, and it is anticipated that the side wager, together with a possibility of winning the pooled jackpot, will help to sustain the player's interest in the game over a period of time.

The technical problem solved by this invention is that of transforming the game of blackjack, when played in an online environment, into one that includes multiple classes of wagers that can be placed on the game, with the success or failure of each class of wager being determined by outcome of a corresponding event. Further, a conventional game of blackjack is automatically transformed into a progressive game in which a portion of each wager falling into a particular class is accumulated in a cumulative jackpot.

Numerous modifications are possible to this embodiment without departing from the scope of the invention. In particular, the stored program in the gaming server can be modified to implement any one or any one or more of a number of well known variations of the game of blackjack, such as the number of decks from which the blackjack hands are dealt, early surrender, splitting and doubling rules. Further, the payouts for successful side wagers can be increased from those described above, and the required rank of cards used to determine the success of a side wager may be other than a 7.

The invention therefore provides a novel wagering system and a method of operation thereof that enables a user to place wagers on a fast-paced game of blackjack in an on-line environment, and which includes a side wager that will enhance and extend a player's interest in the game.

The invention claimed is:

1. A method of operating a gaming server, including the steps of:

the gaming server receiving data relating to an initial wager by a player on an outcome of a turn of a game of blackjack;

the gaming server receiving data relating to an automatic side wager on the occurrence of a different outcome of the same turn of the game of blackjack in response to placement of the initial wager, wherein the different outcome that is the subject of the side wager is a function of a number of different playing cards contained in the blackjack hand dealt to the player in the turn of the game of blackjack;

the gaming server dealing random blackjack hands corresponding to the player and to a dealer;

the gaming server determining the success or otherwise of the initial and the side wagers; and the gaming server settling the successful wagers as a function of the respective outcomes of the turn of the game of blackjack, wherein the side wager is paid at odds of at least 2 to 1 if the first dealt card in the player's hand is of a predetermined rank.

2. A method as claimed in claim 1 that includes the steps of:

accumulating a predetermined portion of each side wager in a pooled jackpot; and maintaining a balance of the pooled jackpot above a predetermined minimum amount at all times during a course of the game of blackjack.

3. A method as claimed in claim 2 that includes the step of incrementing the pooled jackpot at a predetermined rate, even when the player is not playing the game of blackjack.

4. A method as claimed in claim 1 in which the different outcome that is the subject of the side wager is a function of a first three cards dealt in the player's blackjack hand.

5. A method as claimed in claim 1, wherein the side wager is paid at odds of at least 10 to 1 if the first two dealt cards are each of the predetermined rank but of different suites.

6. A method as claimed in claim 1, wherein the side wager is paid at odds of at least 20 to 1 if the first two dealt cards are each of the predetermined rank and are all of the same suite.

7. A method as claimed in claim 1, wherein the side wager is paid at odds of at least 100 to 1 if the first three dealt cards are each of the predetermined rank and are not all of the same suite.

8. A method as claimed in claim 1, wherein the side wager is paid at odds of at least 250 to 1 if the first three dealt cards are each of the predetermined rank and are all of the same suite.

9. A method as claimed in claim 1, wherein the side wager is paid the amount of the pooled jackpot if the first three dealt cards are each of the predetermined rank and are all of a predetermined suite.

* * * * *